United States Patent [19]

Dawant et al.

[11] Patent Number: 4,484,524

[45] Date of Patent: Nov. 27, 1984

[54] PROJECTILE FOR RECOILLESS WEAPON

[75] Inventors: Marcel L. Dawant, Antony; Pierre Guillemain, La Queue en Brie, both of France

[73] Assignee: Societe Europeenne de Propulsion, France

[21] Appl. No.: 513,681

[22] Filed: Jul. 14, 1983

[30] Foreign Application Priority Data

Jul. 16, 1982 [FR] France ..... 82 12503

[51] Int. Cl.[3] ..... F42B 9/12

[52] U.S. Cl. ..... 102/437; 89/1.701

[58] Field of Search ..... 102/430–433, 102/437; 89/1.7, 1.701, 1.706

[56] References Cited

U.S. PATENT DOCUMENTS 3,216,323 11/1965 Wengenroth et al. ..... 102/437
3,329,089 7/1967 Harrison .

FOREIGN PATENT DOCUMENTS 1808386 6/1970 Fed. Rep. of Germany .
2234421 1/1974 Fed. Rep. of Germany .
1225140 6/1960 France .
8026812 7/1982 France .
1204214 9/1970 United Kingdom .

*Primary Examiner*—Harold J. Tudor
*Attorney, Agent, or Firm*—Lerner, David, Littenberg, Krumholz & Mentlik

[57] ABSTRACT

There is disclose a round of ammunition for a recoilless weapon of the type having a launch tube which is open at both ends, comprising a projectile, a propulsive charge positioned behind the projectile, a countermass positioned behind the propulsive charge, and a linking means connecting the countermass to the projectile. The linking means is formed of a plurality of small rigid linking rods of low mass and high ballistic coefficient fixed to the peripheral region of the countermass and on retaining elements located on the rear end of the projectile. The retaining elements are designed to shear during the launching of the projectile when the tensile load exerted on the retaining elements by the linking rods exceeds a predetermined level.

9 Claims, 3 Drawing Figures

PROJECTILE FOR RECOILLESS WEAPON

The present invention relates to a round of ammunition for a recoilless projectile launcher of the type having a launch tube which is open at both ends, the round comprising a projectile, a propulsive charge behind the projectile, and a countermass which is located behind the propulsive charge and which is connected to the projectile, at least when the round is loaded into the launch tube.

Recoilless projectile launchers of the type employing launch tubes which are open at both ends function in accordance with a well-known principle. When the propulsive charge, which is located in the launch tube between the projectile and the countermass, is ignited, the pressure of the gases which are generated by its combustion propels the projectile and the countermass, which forms a mobile breach-plug, in opposite directions.

In order to facilitate the operation of loading into the launch tube the round of ammunition formed by the projectile, the propulsive charge, and the countermass, it is known to interconnect the projectile and the countermass with the aid of suitable linking means. In addition to holding the round together while loading, this linking means must be capable of preventing the two mobile components (the projectile and countermass) from moving until the pressure in the tube generated by the combustion of the charge reaches a certain value, which is termed the forcing pressure. Also the linking means should be capable of permitting the two mobile components to separate easily when the forcing pressure has been reached, and it must not constitute a hazard to the users of the weapon when ejected with the countermass from the rear end of the launch tube.

Various linking means are known, such as a linking collar which encircles the propulsive charge and rigidly interconnects the projectile and the countermass, but none allows all of the above conditions to be met at the same time.

The present invention aims to provide an improved linking means whereby a round of ammunition of the kind described can be produced which is extremely easy to load, guarantees that the projectile and the countermass are immobilised in the launch tube until the forcing pressure is reached and ensures that the weapon crew can use the weapon in safety.

According to the invention therefore, in a round of ammunition of the kind described, the countermass is connected to the projectile by linking means comprising a number of small rigid rods of low mass and a high ballistic coefficient, the linking rods being fixed at one end to the countermass in its peripheral region and attached at the other end to retaining elements on the rear portion of the projectile, the retaining elements being designed to shear when, during launching of the projectile, the tensile load exerted on them by the linking rods exceeds a predetermined value.

The linking rods are preferably composed of fibres which possess a high Young's modulus, such as glass fibres, fibres of a material which is known under the tradename Kevlar, or carbon fibres, and which are rendered rigid with the aid of a resin.

The linking rods are preferably fixed to the countermass by means of an adhesive, or by being incorporated directly into the body of the casing of the countermass.

In a preferred embodiment of the invention the retaining elements are pins which are integral with the body of the projectile, and the ends of the linking rods which are attached thereto are formed as loops which fit over the pins.

The retaining elements, which are preferably integral with the rear portion of the projectile, may be mounted on fairings which are integral with the body of the projectile at its rear end and which pivotally support fins forming a tail assembly of the projectile.

According to another special feature, the round of ammunition in accordance with the invention includes a stop ring adjacent the rear end of the projectile for locating the round in the launch tube, the retaining elements for the linking bars being located in the vicinity of the stop-ring.

The linking rods used in the present invention ensure that the ammunition is easy to load, while exhibiting a rigidity which enables them to support a compressive load. Furthermore, they enable a forcing pressure to be generated in the launch tube when the propulsive charge is ignited, and when the tensile load applied by them to the retaining elements exceeds a predetermined value, the elements shear to allow the projectile to be propelled from the front of the launch tube and the countermass and linking rods to be expelled from the rear. However, the rods do not present any hazard when they are ejected from the rear of the tube, due to the fact that their mass is low and their ballistic coefficient is high. They are thus decelerated over a short distance, immediately on leaving the tube.

One example of a round of ammunition in accordance with the invention will now be described with reference to the accompanying drawings, in which.

Figure 1:
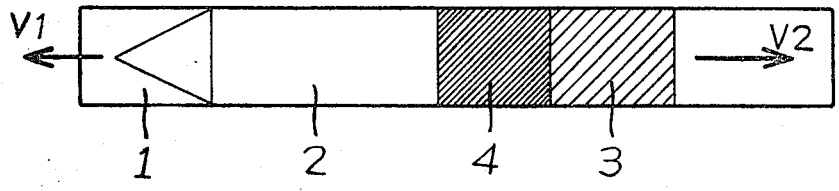
FIG. 1 is a diagrammatic view illustrating the relative positions of the main components of the ammunition when loaded in the launch tube of a recoilless projectile launcher.

FIG. 1 represents, in a diagrammatic manner, a weapon of the type which launches a projectile, such as a rocket, without recoil from an open ended launch tube by igniting a propulsive charge between the projectile and a dispersible mobile breach-plug forming a countermass. The drawing shows a launch tube 1, open at both ends, containing a projectile 2 and a countermass or mobile breach-plug 3 separated by a propulsive charge 4, known as a cartridge. On burning, this cartridge generates gases, and hence a pressure in the tube 1 which propels the projectile and the mobile breach-plug in opposite directions. The nature of the cartridge 4 and the masses of the various components are designed such that the projectile 2 attains a desired velocity $V_1$ at the front end of the tube 1. The mobile breach-plug 3, which is ejected from the rear of the tube 1 at a velocity $V_2$, should be rapidly decelerated on leaving the tube and must not give rise to any element capable of being dangerous outside a safety zone which is defined in accordance with the standards in force for weapons and ammunition of this type. In order to satisfy these requirements, the mobile breach-plug 3 is composed essentially of a material which can fragment.

Figure 2:
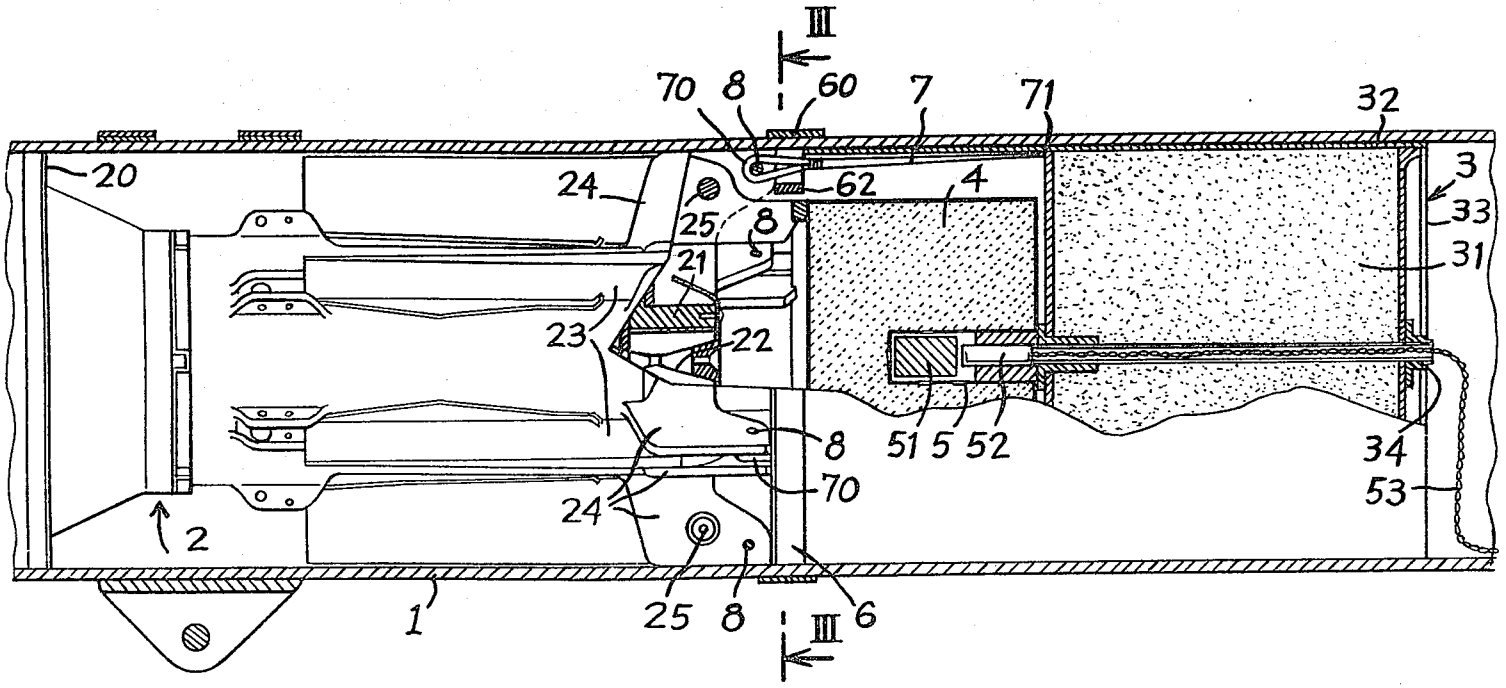
FIG. 2 is a section through a portion of a launch tube showing the round of ammunition in the tube, part of the round being broken away and shown in section to show internal details; and, FIG. 3 is a cross-section along the line III—III in FIG. 2.

FIG. 2 shows, in a more detailed manner, a mobile breach-plug 3 comprising a casing 32 containing a ballast 31 composed, for example, of a finely-broken material. The rear end of the mobile breach-plug 3 is closed by means of a plate 33 which is joined to the casing 32 so that, after firing and the breach-plug 3 has emerged from the rear of the tube 1, the plate 33 separates from the casing 32 and enables the ballast 31 to disperse.

A flexible electrical lead 53, located inside a protective tube 34, passes through the breach-plug 3 to an igniter assembly 5 located at the centre of the cartridge 4 between the breach plug 3 and the rear end of the projectile 2. In the embodiment illustrated, the igniter assembly 5 comprises a primer 52 and a relay charge 51.

The projectile 2 comprises a body 20 having at its rear a rocket-motor body 21 containing a propulsive charge and having a nozzle 22 for restricting the escape of the gases when the charge is ignited. The rocket-motor body 21 carries on its outside a tail assembly comprising fins 23 which are pivotally mounted on hinge-bolts 25 carried by fairings 24 which are integral with the body of the rocket-motor 21. In FIG. 2, the fins 23 are shown in a folded position inside the launch tube 1, this being the position adopted while the round of ammunition is being stored. The fins pivot outwards into their operative portion when the projectile 2 is fired and leaves the tube.

Figure 3:
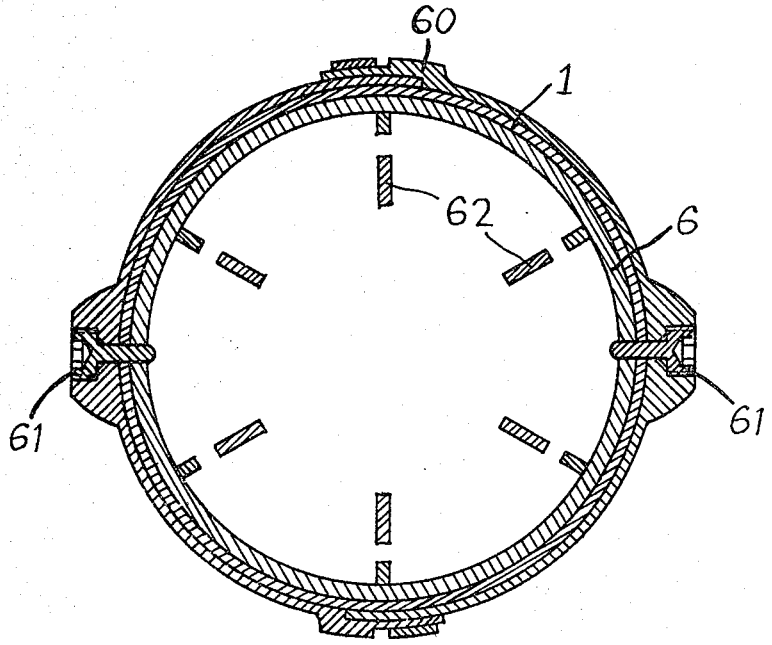

The round of ammunition defined by the projectile 2, the mobile breach-plug 3, and the cartridge 4, is immobilised inside the launch tube 1 with the aid of a ring 6, which is known as a stop-ring. This ring 6 is integral with the round, and is fixed in the tube 1 by, for example, an external collar-system 60 carrying positioning pins 61 which can be inserted radially through the tube 1 to engage the stop ring 6 (see FIG. 3). The relative positions of the ring 6 and of the projectile 2 can be defined by radial elements 62 which are integral with the ring 6 and are intercalated between the fins 23 of the tail assembly of the projectile 2. By means of the positioning pins 61, the complete round of ammunition can be positioned in the launch tube 1 in a precise manner, both longitudinally and radially.

For convenience, and to ensure safe loading of the round of ammunition into the tube 1, it is desirable for the round comprising the projectile 2, the mobile breach-plug 3, the cartridge 4, and the stop-ring 6, to be assembled as a unit for insertion into the tube 1. However, the cartridge 4 is an element without mechanical strength, and it is therefore necessary that the projectile 2 and the branch plug 3 should be connected together in a sufficiently rigid manner to transmit a compressive load and maintain the proper relative positions of the projectile 2 and breach plug 3 during loading. The connection should also guarantee that, on firing, the projectile 2 and the breach-plug 3 will remain in place inside the launch tube 1 until the pressure between them in the tube reaches a certain value which defines a forcing pressure. The linking connection thus plays the part not only of rendering the round of ammunition rigid when it is being loaded, but also serves to create a round of ammunition of the forcing-pressure type.

As can be seen in FIG. 2, in the round in accordance with the invention the mobile breach-plug 3 and the projectile 2 are connected by a number of linking rods 7 which are fixed to the breach-plug 3 and are hooked onto the rear end of the projectile 2 by means of end-loops 70 which fit around retaining pins 8 mounted on the projectile 2. The retaining pins 8 may, as shown, be provided on extensions of the fairings 24 which support the hinge-bolts 25 for the fins 23 of the tail assembly of the projectile.

The fixing of the ends 71 of the linking rods 7 to the breach-plug 3 should be of the highest quality, and may be effected either by bonding the ends 71 to the casing 32 of the breach plug, or by integral incorporation of the rods into the body of the casing 32.

The essential function of the rods 7 is to hold the round together during loading and to transmit the tensile load which is necessary in order to shear the retaining pins 8 to break the connection between the projectile and the breach plug at the desired moment after firing. However, the mass of the rods 7 must be very low, and their ballistic coefficient, which is defined as the ratio of the aerodynamic drag to the mass, must be high in order to ensure that the rods are decelerated over a short distance after exit from the rear end of the launch tube 1 when the round is fired, and thus do not form dangerous projectiles. By way of example, the mass of a rod 7 may be of the order of one thousandth of the total mass of the round of ammunition.

It is particularly advantageous to manufacture the rods 7 from a fibre-based material, comprising fibres which possess a high Young's modulus, such as carbon fibres, glass fibres, or fibres of the material known by the tradename Kevlar, and which have been rendered rigid with the aid of a resin.

The rods 7 are positioned around the cartridge 4 near the launch tube wall, and can easily be adapted to suit different types of projectile or different types of mobile breach-plug, since it suffices to produce, on the one hand, a connection between one end 71 of the rods and the breach-plug casing 32, and, on the other hand, a connection between the other end 70 of the rods and retaining pins 8 at the rear of the projectile 2. The pins 8 can be formed without difficulty and may easily be adjusted to break under a predetermined tensile load exerted by the rods 7, this load corresponding to a predetermined forcing pressure depending on interior-ballistics calculations relating to the ejection of the projectile 2 and of the breach-plug 3 when the weapon is fired.

In operation, the firing command is transmitted by the electrical cable 53 to the igniter assembly 5, which initiates the combustion of the charge of powder 4. The combustion gases generate a pressure in the combustion chamber, which is defined by the volume between the projectile 2 and the mobile breach-plug 3, and this pressure gives rise to a force which tends to separate the two components 2 and 3, which are connected by the rods 7. Under the tensile load resulting from this force, the linking rods 7 transmit a shearing load to the retaining pins 8, and these pins break when the forcing pressure reaches the predetermined value defined by the interior-ballistics calculations. The projectile 2 and the breach-plug 3 are then released, and are propelled from opposite ends of the tube 1 as indicated in FIG. 1.

We claim:

1. A round of ammunition for a recoilless projectile launcher of the type having a launch tube which is open at both ends, said round comprising a projectile having forward and rear ends, a propulsive charge behind said rear end of said projectile, a countermass behind said propulsive charge, and linking means connecting said countermass to said projectile, at least when said round is loaded into said launch tube, said linking means comprising a plurality of small rigid linking rods of low mass and a high ballistic coefficient, each of said linking rods having first and second ends, means fixing said first ends of said linking rods to said countermass in a peripheral region thereof, and retaining elements on said rear end portion of said projectile interacting with said second ends of said linking rods to attach said linking rods to said projectile, said retaining elements being designed to shear when, during launching of said projectile, the tensile load exerted on said retaining elements by said linking rods exceeds a predetermined value.

2. A round of ammunition as claimed in claim 1, wherein each of said linking rods is composed of fibres possessing a high Young's modulus, and resin bonding said fibres together to render said rod rigid.

3. A round of ammunition as claimed in claim 2, wherein said fibres are glass fibres.

4. A round of ammunition as claimed in claim 2, wherein said fibres are carbon fibres.

5. A round of ammunition as claimed in claim 1, wherein said means fixing said first ends of said linking rods to said countermass comprises an adhesive.

6. A round of ammunition as claimed in claim 1, wherein said countermass includes a peripheral casing, and said means fixing said first ends of said linking rods to said countermass comprises direct incorporation of said first ends into said casing of said countermass.

7. A round of ammunition as claimed in claim 1, wherein said retaining elements are pins integral with the body of said projectile at said rear end thereof, and said second ends of said linking rods comprise loops which fit over said pins.

8. A round of ammunition as claimed in claim 1, wherein said projectile includes a body, fairings integral with said body at said rear end of said projectile, and fins pivotally connected to said fairings to form a tail assembly of said projectile, and said retaining elements are mounted on said fairings.

9. A round of ammunition as claimed in claim 1, wherein said round further comprises a stop ring adjacent said rear end of said projectile for locating said round in said launch tube.

* * * * *